US006895755B2

(12) United States Patent
Steinthorsson et al.

(10) Patent No.: US 6,895,755 B2
(45) Date of Patent: May 24, 2005

(54) NOZZLE WITH FLOW EQUALIZER

(75) Inventors: Erlendur Steinthorsson, Westlake, OH (US); Kiran Patwari, Highland Heights, OH (US); Jie Qian, Palmyra, NY (US); Joseph S. Quadrone, Clifton Springs, NY (US)

(73) Assignee: Parker-Hannifin Corporation, Cleveland, OH (US)

( * ) Notice: Subject to any disclaimer, the term of this patent is extended or adjusted under 35 U.S.C. 154(b) by 0 days.

(21) Appl. No.: 10/366,304

(22) Filed: Feb. 13, 2003

(65) Prior Publication Data

US 2003/0164410 A1 Sep. 4, 2003

Related U.S. Application Data

(60) Provisional application No. 60/361,508, filed on Mar. 1, 2002.

(51) Int. Cl.[7] ..... F02C 7/22; F23R 3/14

(52) U.S. Cl. ..... 60/742; 60/748

(58) Field of Search ..... 60/742, 748

(56) References Cited

U.S. PATENT DOCUMENTS 3,283,502 A * 11/1966 Lefebvre ..... 60/742
4,938,418 A * 7/1990 Halvorsen ..... 239/390
5,228,283 A * 7/1993 Sciocchetti ..... 60/742
5,337,961 A * 8/1994 Brambani et al. ..... 60/742

* cited by examiner

*Primary Examiner*—Ted Kim
(74) *Attorney, Agent, or Firm*—Chirstopher H. Hunter

(57) ABSTRACT

A fuel injector for a gas turbine engine has an inlet fitting, a fuel nozzle, and a housing stem with a pair of fuel conduits fluidly interconnecting the nozzle and fitting. The fuel nozzle includes an annular secondary fuel passageway directing fuel from one fuel conduit to an annular discharge orifice at a discharge end of the nozzle. The secondary fuel passageway is defined between an outer, annular fuel conduit portion and a primary adapter. The primary adapter has an outer surface with a distinct, radially-outwardly-projecting annular shoulder to restrict flow through the secondary passageway and provide substantially uniform distribution of flow through the passageway downstream of the shoulder, for improved combustion and flame stability.

19 Claims, 9 Drawing Sheets

NOZZLE WITH FLOW EQUALIZER

CROSS-REFERENCE TO RELATED CASES

The present application claims the benefit of the filing date of U.S. Provisional Application Ser. No. 60/361,508; filed Mar. 1, 2002, the disclosure of which is expressly incorporated herein by reference.

FIELD OF THE INVENTION

The present invention relates generally to fuel injectors for gas turbine engines of aircraft, and more particularly to nozzles for such fuel injectors.

BACKGROUND OF THE INVENTION

Fuel injectors for gas turbine engines on an aircraft direct fuel from a manifold to a combustion chamber. The fuel injector typically has an inlet fitting connected to the manifold for receiving the fuel, a fuel spray nozzle located within the combustion chamber of the engine for atomizing (dispensing) the fuel, and a housing stem extending between and supporting the fuel nozzle with respect to the fitting. Appropriate check valves and/or flow dividers can be disposed within the fuel nozzle to control the flow of fuel through the nozzle. The fuel injector is typically heat-shielded to protect the injector from the high operating temperatures within the engine casing. Multiple injectors can be attached to the combustor casing of the engine in a spaced-apart manner to dispense fuel in a generally cylindrical pattern.

Fuel conduit(s) are provided through the housing stem, and direct fuel received in the fitting into the upstream end of the nozzle. As illustrated in FIG. 1, in a prior art dual-flow system (i.e., with primary and secondary flows), a primary adapter 10 is provided centrally within the nozzle 12 and fuel is directed downstream within the nozzle in two passageways. A first (inner) passageway 14 is provided centrally within the adapter and fluidly interconnects a first fuel conduit 16 in the housing stem 18 with a first, central discharge orifice 20 at the discharge end of the nozzle. A second (outer) passageway 22 is provided between the outer surface of the adapter and a heat shield/fuel conduit portion 24 surrounding the adapter, and fluidly interconnects a second fuel conduit 26 in the housing stem with a second, annular discharge orifice 28 at the discharge end of the nozzle, with the second discharge orifice 28 having a generally annular configuration concentrically surrounding the first discharge orifice 20. At the downstream end of the nozzle, geometry (such as swirler vanes 30) may be provided in the first and/or second passageways to impart a swirling component of motion to the fuel. The fuel sprays are applied to a prefilmer 31, and directed outwardly from the discharge end of the nozzle in a conical spray of fuel. The swirling spray is ignited downstream of the nozzle in the combustor.

While the nozzle design described above has been used for many years and provides a satisfactory fuel spray, one aspect of such a design is that the fuel flow must turn a sharp ninety degrees from the fuel conduits in the housing stem to the fuel passageways in the nozzle, and is directed into the second (outer) passageway through an opening 32. Opening 32 is located toward the upper portion of the passageway, and is sometimes kidney-shaped. As can be appreciated, as the fuel is directed into the annular, outer passageway 22 from the opening 32, there is a sudden expansion of the flow path. At low or moderate fuel flow rates and pressures typical of start-up and cruise conditions, the fuel entering the second passageway tends to be directed to the upper (12 o'clock) portion of the annulus. The fuel then tends to flow axially and (somewhat) circumferentially/azimuthally downstream in the passageway, however the greater volume and density of fuel remains in the upper portion of the passageway all the way to the discharge orifice, and recirculation zones form in the passageway annulus at the opposite (6 o'clock) location. The recirculation zones are detrimental for total-pressure loses and heat transfer in the nozzle, as they increase the fuel residence time in the nozzle. The propensity for carbon formation (coking) in this region also increases. The spray from the nozzle also tends to have non-uniform distribution of fuel, which decreases the efficiency of combustion and the stability of the flame. At high power (take-off) conditions, the fuel is highly turbulent and so these effects are somewhat reduced—but they are still an issue.

Referring to FIG. 2, it is known to provide an annular flange 34 at the upstream end of the adapter having a dimension slightly smaller than the inner dimension of the surrounding fuel conduit 36. An arcuate or wedge-shaped portion (indicated generally at 37) of the flange is removed, with the removed portion being located approximately 180 degrees from the inlet opening 32. When the fuel enter the upstream end of the passageway, some of the fuel is forced to flow to the opposite side of the passageway before it can flow across the flange, which thereby causes more uniform distribution of the fuel around the passageway. It is necessary to rotationally orient ("clock") the adapter in the nozzle during assembly such that the removed portion is properly rotationally oriented with respect to the inlet opening. As can be appreciated, this requires additional cooperating structure between the adapter and nozzle, and complicates the manufacturing and assembly process.

It is noted this design includes an annular shoulder 38 downstream of the flange; however it is believed the shoulder is used primarily to facilitate atomization of the fuel because of its location downstream along the adapter. The shoulder also has a relatively sharp edge, and if the edge is located too close to the surrounding fuel conduit, the edge can cause fuel separation and high pressure drop. Thus, it is believed the shoulder in this nozzle design is not intended to provide significant fuel distribution around the circumference of the passageway, beyond what is provided by the upstream flange.

Thus it is believed there is a demand in the industry for a further improved fuel injector for gas turbine engines, and particularly for an improved nozzle for such an injector, which provides a substantially uniform spray for efficient combustion and stability of the flame, and which reduces the complexity (and cost) of manufacture and assembly of the nozzle.

SUMMARY OF THE INVENTION

The present invention provides a novel and unique fuel injector for a gas turbine engine of an aircraft, and more particularly, a novel and unique nozzle for a fuel injector. The nozzle provides substantially uniform spray for efficient combustion and stability of the flame; and has reduced complexity and cost as compared to prior designs.

According to the principles of the present invention, the fuel injector has an inlet fitting for receiving fuel, a fuel nozzle for dispensing fuel, and a housing stem fluidly interconnecting the fuel nozzle and the fitting.

The fuel nozzle includes a primary adapter, which directs a primary fuel flow and secondary fuel flow through the nozzle. The primary fuel flow is provided centrally through the adapter to a central discharge orifice at the discharge end of the nozzle. The secondary fuel flow is provided through a secondary passageway defined between an outer surface of the adapter and a fuel conduit portion surrounding the adapter. The primary adapter has an outer surface with a distinct, radially-outwardly projecting, annular shoulder. The shoulder is located upstream along the adapter, proximate the flow opening from the secondary fuel conduit. The shoulder has an annular peripheral edge with a radius, and an annular flat surface which faces upstream in the nozzle and interconnects a radially-reduced upstream portion of the adapter with a radially-enlarged downstream portion of the adapter.

The shoulder on the adapter causes the flow to be restricted between the adapter and the surrounding fuel conduit, and thereby tends to direct the fuel around the circumference of the annular passageway. The rounded edge of the shoulder prevents or at least minimizes stream fuel separation of the fuel and pressure drop. The primary adapter narrows downstream of the shoulder to reduce the flow velocity and to also reduce pressure drop, as well as to generally encourage flow through the nozzle. The outer surface geometry on the adapter thereby increases the uniform distribution of flow through the secondary passageway, which reduces recirculation zones in the secondary passageway and increases the minimum heat transfer coefficient without substantial increase in pressure drop. The fuel injector of the present invention thereby provides more efficient combustion and flame stability in the combustion chamber.

The primary adapter can be assembled in the nozzle using conventional processes, without the need for rotational orientation, as the adapter is symmetrical about its axis. This reduces the complexity and cost of the nozzle. The fuel injector can also be easily mounted on the casing for the engine combustor by a flange extending outwardly from the housing stem, and easily disassembled for inspection or replacement.

Other features and advantages of the present invention will become further apparent upon reviewing the following specification and attached drawings.

DETAILED DESCRIPTION OF THE PREFERRED EMBODIMENT

Figure 3:
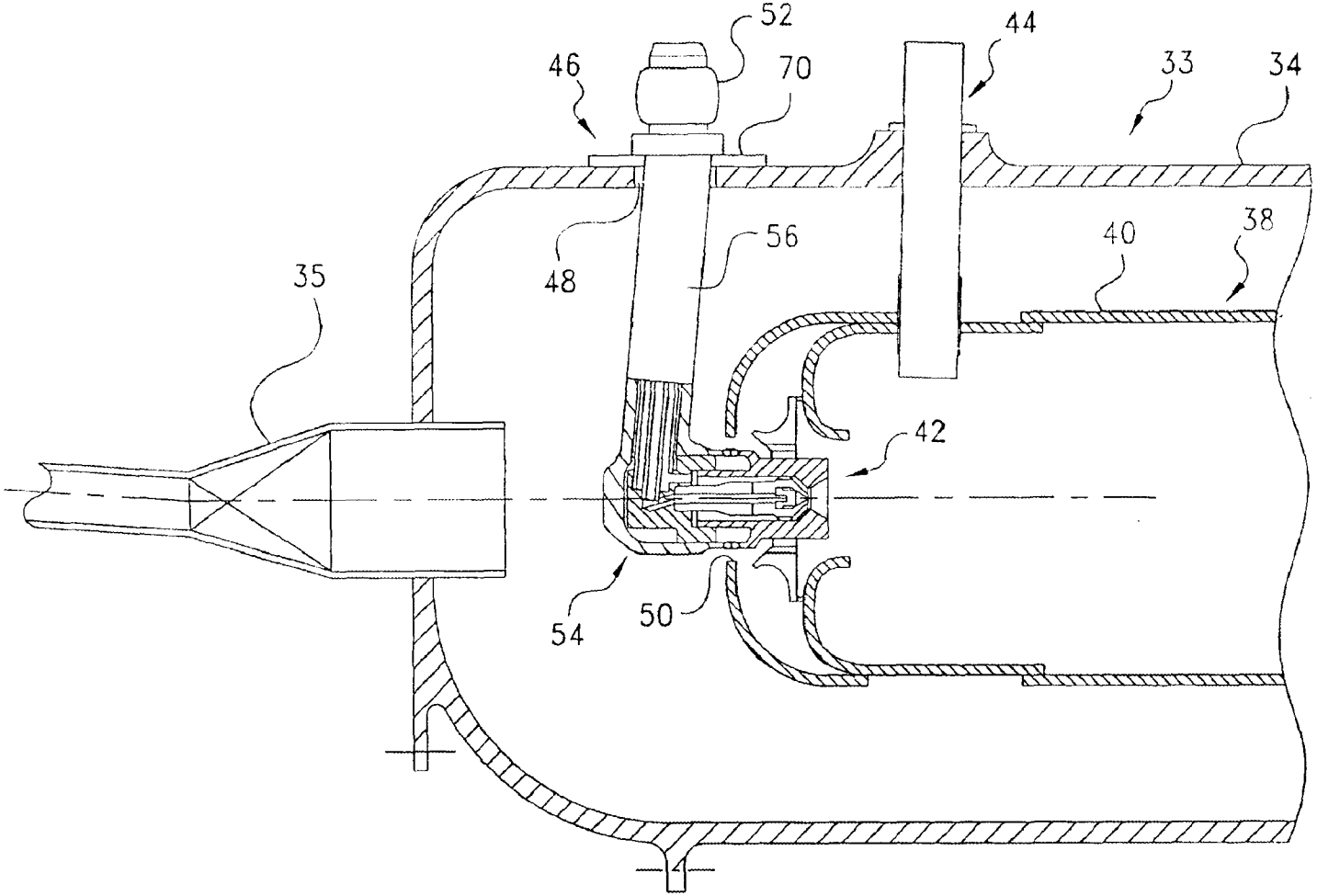
FIG. 3 is a perspective view of a portion of a gas turbine engine illustrating a fuel injector constructed according to the principles of the present invention.

Referring to FIG. 3, a gas turbine engine for an aircraft is illustrated generally at 33. The gas turbine engine 33 includes an outer casing 34 extending forwardly of an air diffuser 35. The casing and diffuser enclose a combustor, indicated generally at 38, for containment of burning fuel. The combustor 38 includes a liner 40 and a combustor dome, indicated generally at 42. An igniter, indicated generally at 44, is mounted to casing 34 and extends inwardly into the combustor for igniting fuel. The above components are conventional in the art and their manufacture and fabrication are well known.

A fuel injector, indicated generally at 46, is received within an aperture 48 formed in the engine casing and extends inwardly through an aperture 50 in the combustor liner. Fuel injector 46 includes a fitting 52 disposed exterior of the engine casing for receiving fuel; a fuel nozzle, indicated generally at 54, disposed within the combustor for dispensing fuel; and a housing stem 56 interconnecting and structurally supporting nozzle 54 with respect to fitting 52.

Figure 4:
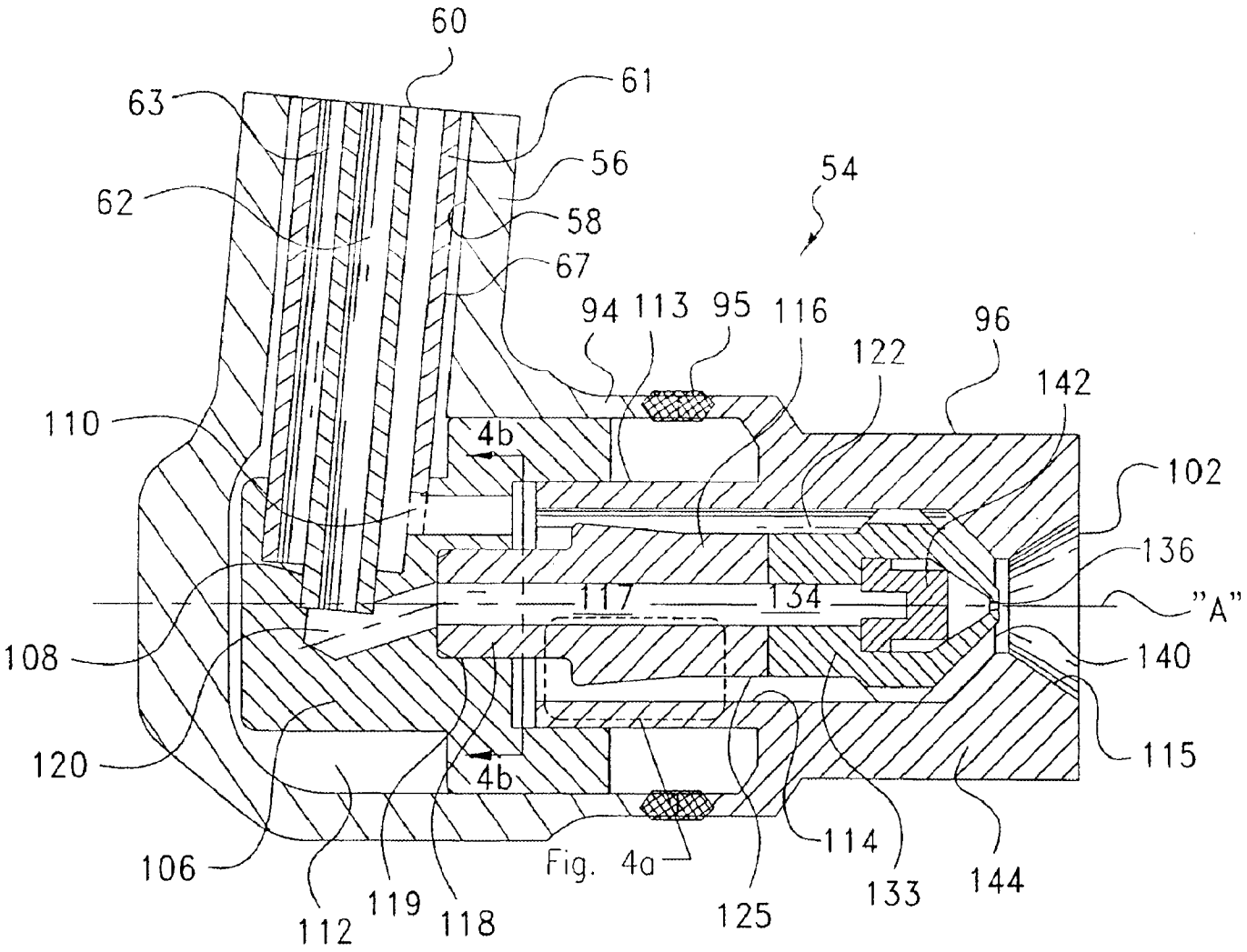
FIG. 4 is a cross-sectional side view of a portion of the nozzle for the fuel injector of FIG. 3.

Referring now to FIG. 4, housing stem 56 includes a central, longitudinally-extending bore 58 extending the length of the stem. Primary and secondary fuel conduits 60, 61 extend through the bore and fluidly interconnect fitting 52 and nozzle 54. Appropriate valves (not shown) are provided in the stem, in the fitting and/or upstream of the fitting to control the introduction of fuel into the conduits. Primary fuel conduit 60 has a hollow central passage 62 to direct fuel in a primary fuel circuit; while secondary fuel conduit 61 circumferentially surrounds primary conduit 60 and defines therewith a passage 63 to direct fuel in a secondary fuel circuit. An air gap 67 is provided between the housing stem 56 and the outer fuel conduit 61 for thermal management. Housing stem 56 has a thickness sufficient to support nozzle 54 in the combustor when the injector is mounted to the engine, and is formed of material appropriate for the particular application. While not shown, a heat shield can be provided around housing stem 56, if necessary or desirable.

As shown in FIG. 3, an annular flange 70 is formed in one piece with the housing stem 56 proximate the fitting 52, and extends radially outward therefrom. Flange 70 includes appropriate apertures to allow the flange to be easily and securely connected to, and disconnected from, the casing of the engine using, e.g., bolts or rivets. Flange 70 preferably has a flat lower surface which is disposed against a flat outer surface of the casing.

Referring again to FIG. 4, the housing stem 56 is formed integrally with fuel nozzle 54, and preferably in one piece with at least a portion of the nozzle. To this end, the lower end of the housing stem includes an annular outer shroud 94 circumscribing the longitudinal axis "A" of the nozzle 54. Outer shroud 94 is connected (such as by welding at 95) at its downstream end to an annular outer nozzle heat shield 96. Heat shield 96 extends to the discharge end of the nozzle, indicated at 102, for thermal and structural protection.

A tip adapter 106 is received in the downstream end of the housing stem to direct the fuel flow ninety degrees from the fuel conduits 60, 61 in the housing stem to the fuel passageways in the nozzle. To this end, tip adapter 106 includes a first bore 108 receiving the downstream end of the primary conduit 60; and a second counterbore 110 receiving the downstream end of the secondary fuel conduit 61. The primary and secondary fuel conduits can be fixed within their respective bores by any appropriate means, such as brazing. An air gap 112 outwardly surrounds the tip adapter to provide thermal management.

An annular inner nozzle heat shield 113 is concentrically located internally of the outer heat shield 96, and is fixed (such as by brazing) at its upstream end to the tip adapter 106, and is fixed (such as by being unitary) at its downstream end to the heat shield 96. The heat shield 113 has a cylindrical inner surface 114 and defines a portion of a fuel conduit, as will be described below. The downstream end of the outer heat shield 96 tapers radially inward, and then outwardly to define a frustoconical prefilmer surface 115.

A primary adapter 116 is fixed to the downstream end of the tip adapter 106 to create the fuel passageways through the nozzle. To this end, the primary adapter 116 includes an internal bore defining a primary fuel passageway 117 extending through the adapter from the upstream end to the downstream end. The primary adapter 116 includes a reduced-diameter, cylindrical upstream portion 118 which is received in a counterbore portion 119 of a bore 120 in tip adapter 106, to fluidly connect primary fuel passage 117 in adapter 116 with fuel passage 62 in primary fuel conduit 60. The upstream portion 118 of the adapter can be fixed to the tip adapter in any conventional manner, such as by brazing.

Figure 4B:
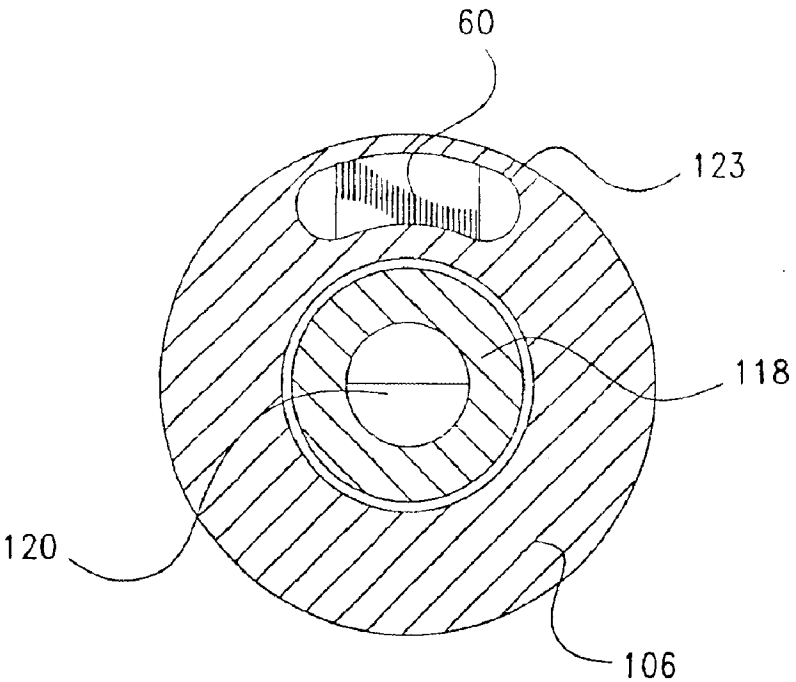
FIG. 4B is a cross-sectional end view of the nozzle taken substantially along the plane described by the lines 4A—4A of FIG. 4.
Figure 4A:
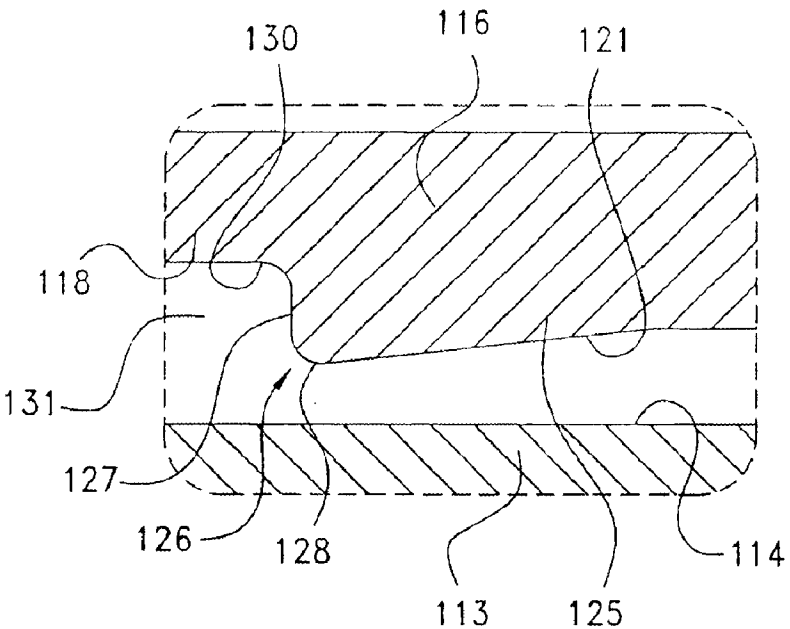
FIG. 4A is an enlarged cross-section of a portion of the nozzle shown in FIG. 4.

As shown in FIG. 4A, the primary adapter 116 includes an outer, cylindrical surface 121 which together with the inner surface 114 of conduit portion 113, defines an annular secondary flow passageway 122 through the nozzle. As shown in FIG. 4B, the tip adapter 106 includes a second bore 123 which is axially aligned with an opening 124 toward the end of the second conduit 61 in the housing stem. Second bore 123 fluid interconnects the secondary fuel passage 63 in conduit 61 with the secondary fuel passageway 122 in nozzle 54. The opening 124 and bore 123 are illustrated as being kidney-shaped configuration, which has been found to be a structurally sound and efficient configuration to direct a maximum amount of fuel from the conduit 61 to the annular passageway 122, however other shapes (such as circular) can also be used. As described above, opening 123 directs fuel mainly into the upper (12 o'clock) portion of the secondary passageway. It should be noted that generally only a single opening is provided, however, some applications include multiple openings, but can still suffer from the uneven flow characteristics described above.

The adapter 116 further includes an enlarged diameter, cylindrical downstream portion 125. The downstream portion 125 is interconnected to the reduced-diameter upstream portion 118 by an annular shoulder, indicated generally at 126. Shoulder 126 is located at the upstream end of the adapter and has a distinct, annular, upstream-facing flat front face 127; and a rounded peripheral annular edge 128, that is, an edge with a radius, interconnecting the shoulder with the enlarged diameter portion 125 and spaced somewhat close to the surrounding heat shield/fuel conduit 112. Front face 127 preferably extends perpendicular, or at least substantially perpendicular, to the central axis of the adapter, although it might also have a downstream tapered (conical or frustoconical) geometry. The shoulder 126 has a rounded inner annular edge 130 interconnecting the shoulder with the reduced-diameter portion 118. The enlarged-diameter portion 125 generally tapers inwardly (narrows) slightly from shoulder 126, downstream along the nozzle.

Fuel passing through opening 123 from the second fuel conduit 61 passes into an annular, unobstructed flow distribution channel 131 (FIG. 4A) defined at the upstream end of the primary adapter. The fuel is then restricted somewhat from passing downstream along the secondary passageway because of the geometry of the annular shoulder 126, and the close relationship between the edge 128 of the shoulder and the surrounding fuel conduit 113. The fuel impinges upon the flat annular front surface 127, and spreads circumferentially around the channel 131. The fuel also passes across the rounded corner of the shoulder, and is directed azimuthally along the secondary fuel passageway, so that the fuel is substantially uniformly distributed around the passageway as it travels downstream along the adapter. The rounded edge of the shoulder reduces pressure drop and prevents (or at least minimizes) stream separation. The taper/narrowing of the adapter along the enlarged diameter portion 125 is generally small, to also prevent stream separation of the fuel. The increased flow area caused by the narrowing of the adapter reduces the pressure drop of the fuel and generally facilitates the flow of fuel along the secondary fuel passageway.

As should be appreciated, the axial location and diameter of the shoulder 126 (that is, the location and flow area of the resulting annular orifice between the shoulder 126 and the fuel conduit portion 113); the radius of the shoulder edge 128; the taper of the enlarged diameter portion 125; and the length and size of the secondary passageway effect the distribution of the fuel along the secondary fuel passageway. These parameters can be determined upon simple experimentation and analysis depending upon the particular application for the nozzle (e.g., the required fuel flow, pressure drop, heat transfer characteristics, operating temperatures, etc). It is noted that increasing the diameter of the shoulder and locating the shoulder closer the opening 123 will cause increased distribution of the fuel around the periphery, but a smaller flow path will also increase the pressure drop through the nozzle. These factors can be balanced depending upon the particular application.

A primary orifice body 133 is located at the downstream end of adapter 116 and is fixed thereto, such as by brazing. Primary orifice body 133 has a central fuel passage 134 fluidly connected with fuel passage 117, and which extends to a central, downstream primary discharge orifice 136 to discharge fuel received from the primary fuel conduit 60 at the downstream end of the nozzle. The primary orifice body 133 and the downstream end of the outer nozzle heat shield 96 define a secondary, annular discharge orifice 140, concentric with the primary discharge orifice 136, to discharge fuel received from the secondary fuel conduit 61 at the discharge end of the nozzle.

An annular swirler member 142 is located internally of the primary orifice body 133 and has geometry (i.e., vanes or slots) designed to provide swirl to fuel passing through the primary flow passageway 117. Likewise, the primary orifice body 133 includes exterior vanes or slots as at 144 which closely mate with the surrounding fuel conduit 113 and which are configured to provide swirl to fuel passing through the secondary fuel passageway 122.

As should be appreciated, the nozzle described above is a "pressure atomization" nozzle, and fuel provided through the primary fuel passageway 117 in primary adapter 116 is discharged in a swirling cone out through primary discharge opening 136; from where the fuel mixes with any fuel in the secondary fuel passageway 122, and is applied against prefilmer surface 115, and then releases from the prefilmer surface in a swirling, conical spray of fuel. As the fuel is substantially evenly and uniformly provided through secondary passageway 122, the resulting spray cone is evenly distributed for efficient combustion and flame stability in the combustion chamber.

The pressure-atomizer type of nozzle described above is formed from an appropriate heat-resistant and corrosion resistant material which should be known to those skilled in the art, and is formed using conventional manufacturing techniques. While a preferred form of the nozzle has been described above, it should be apparent to those skilled in the art that other nozzle (and stem) designs could also be used with the present invention. As an example, the flow equalizer feature of the present invention could likewise be used with an airblast type of nozzle (i.e., with an annular fuel flow path surrounding a central air passage). As such, the present invention is not limited to any particular nozzle design, but rather is appropriate for a wide variety of known nozzles.

In any case, in assembling the fuel injector, the symmetrical nature of the adapter allows simple and easy assembly with the nozzle—without the need for clocking or other cooperating structure to rotationally orient the adapter. The assembled fuel injector can then be inserted through the opening 48 in the engine casing (see FIG. 3), with the nozzle being received within the opening 50 in the combustor. The flange 70 on the fuel injector is then secured to the engine casing such as with bolts or rivets. The nozzle is not otherwise attached to the combustor to allow for simple and rapid removal of the fuel injector from the engine casing.

Thus, as described above, the assembly of the internally heatshielded nozzle is fairly straight-forward and can be accomplished using only a few assembly steps with common assembly techniques. There are no complicated internal components, which thereby reduces the cost of the fuel injector.

Figure 1:
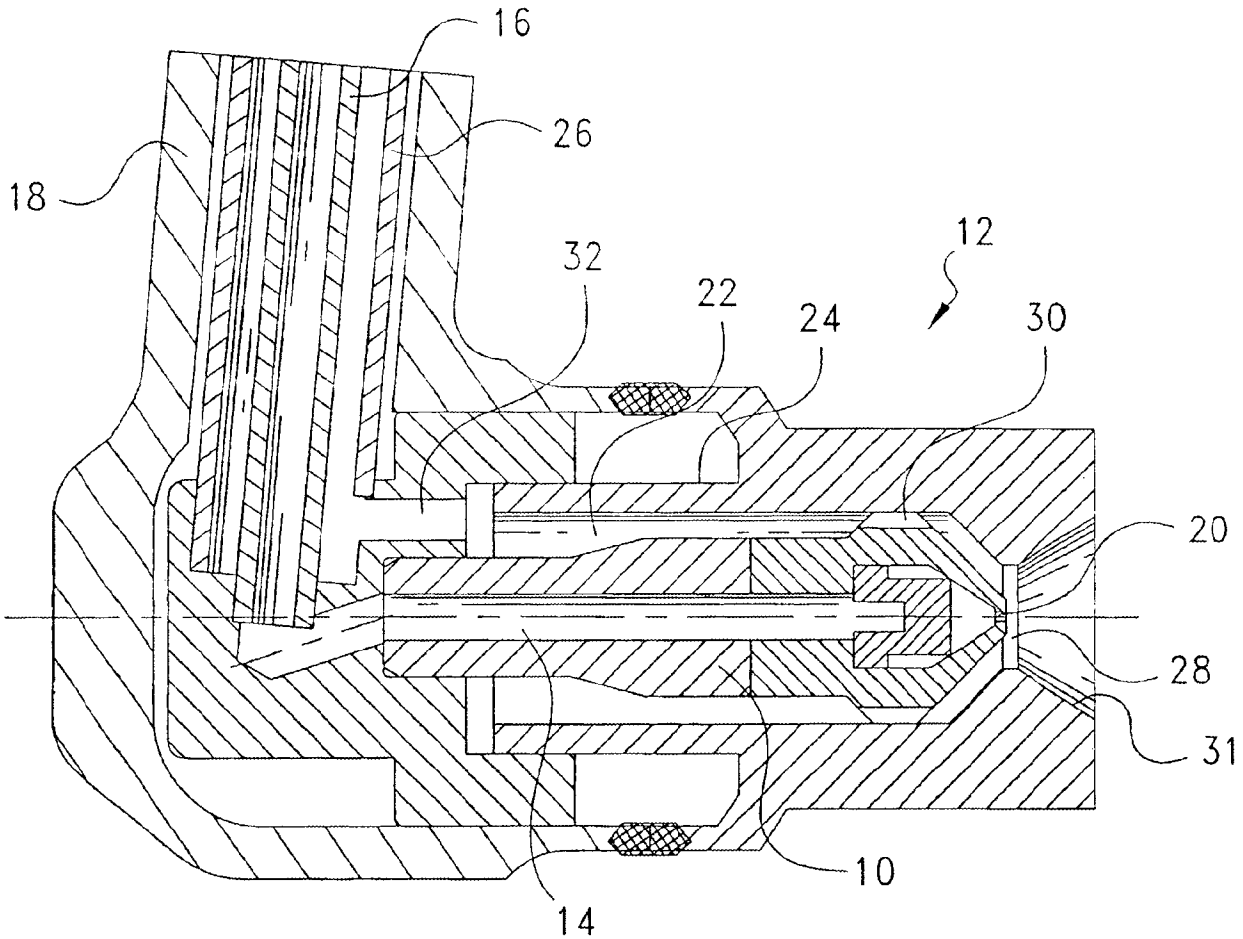
Fig. 1 (PRIOR ART)
FIG. 1 is a cross-sectional side view of the nozzle portion of a prior art fuel injector.
Figure 2:
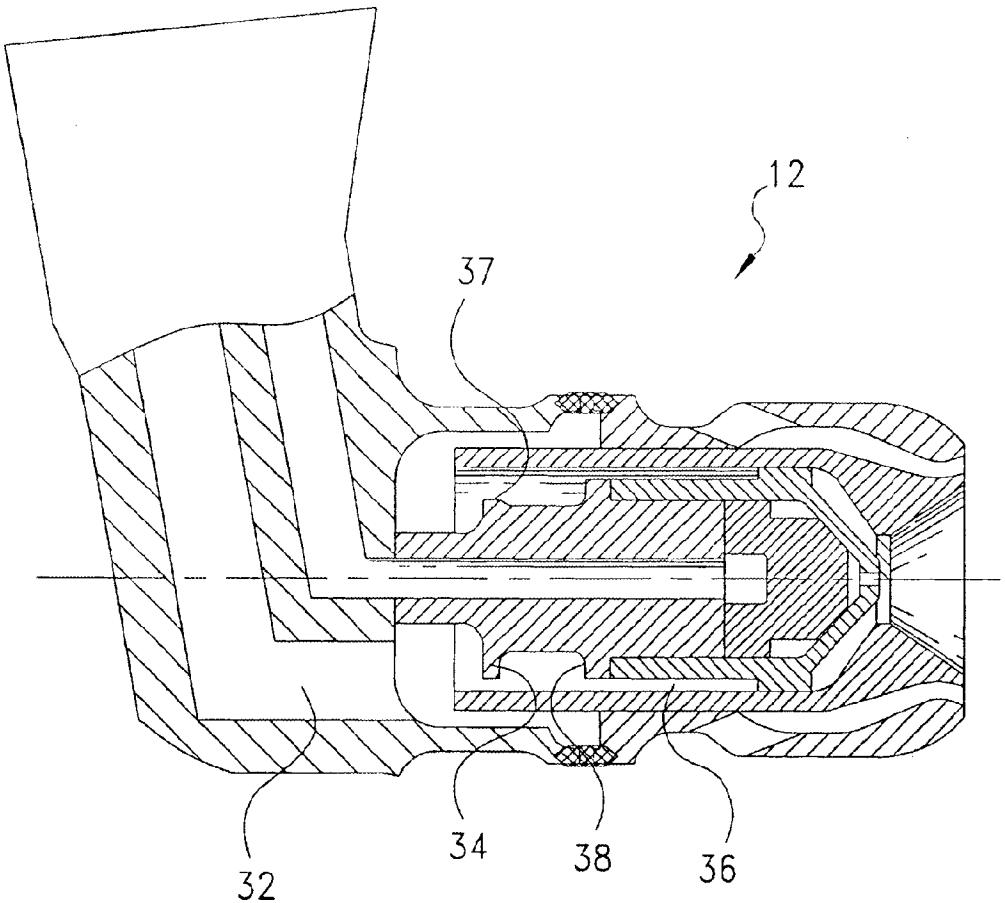
Fig. 2 (PRIOR ART)
FIG. 2 is a partial cross-sectional side view of the nozzle portion of another prior art fuel injector.
Figure 5:
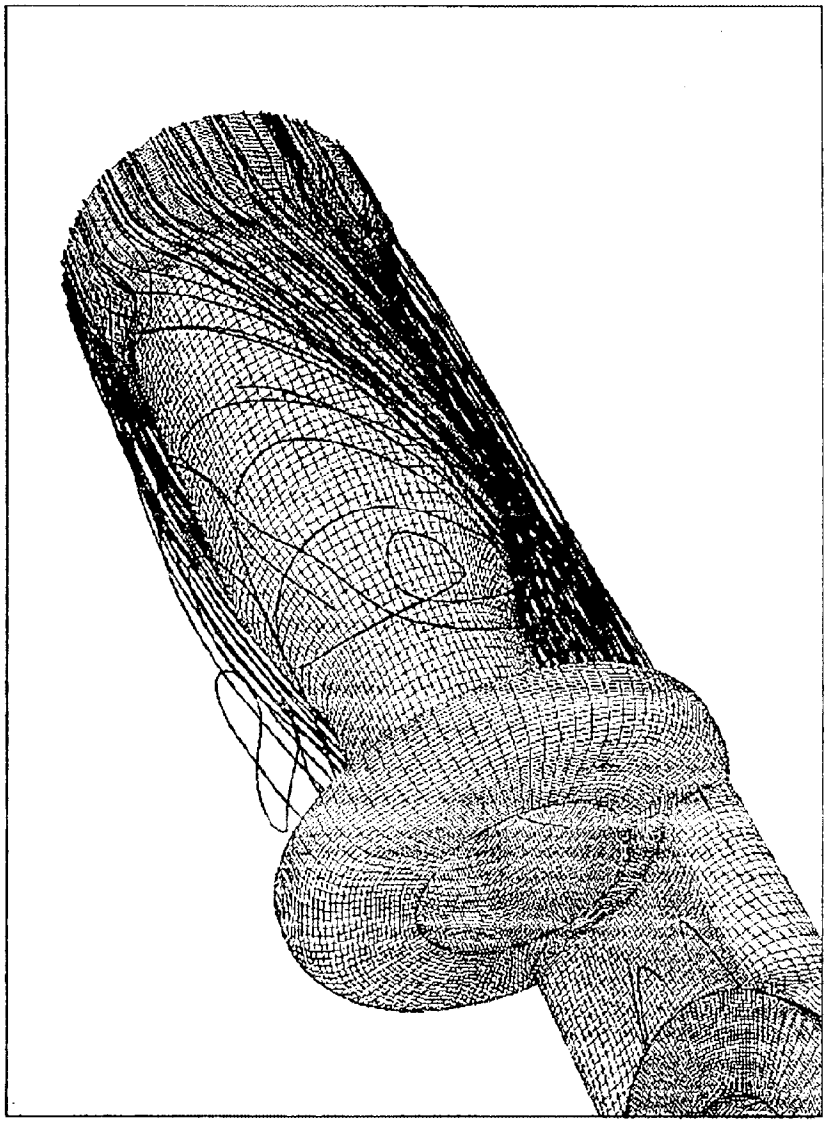
FIG. 5 is an analysis of the mean flow at take-off for a prior art fuel injector.
Figure 6:
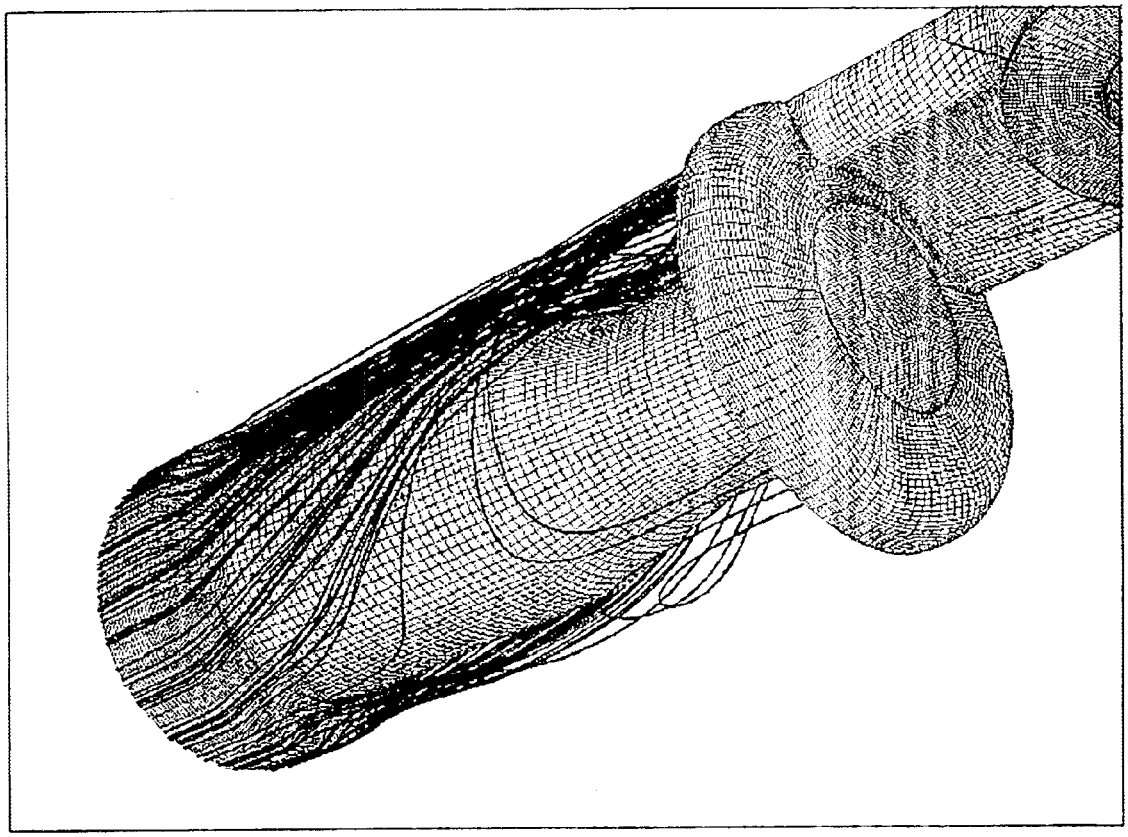
FIG. 6 is an analysis of the mean flow at descent for the prior art fuel injector.
Figure 7:
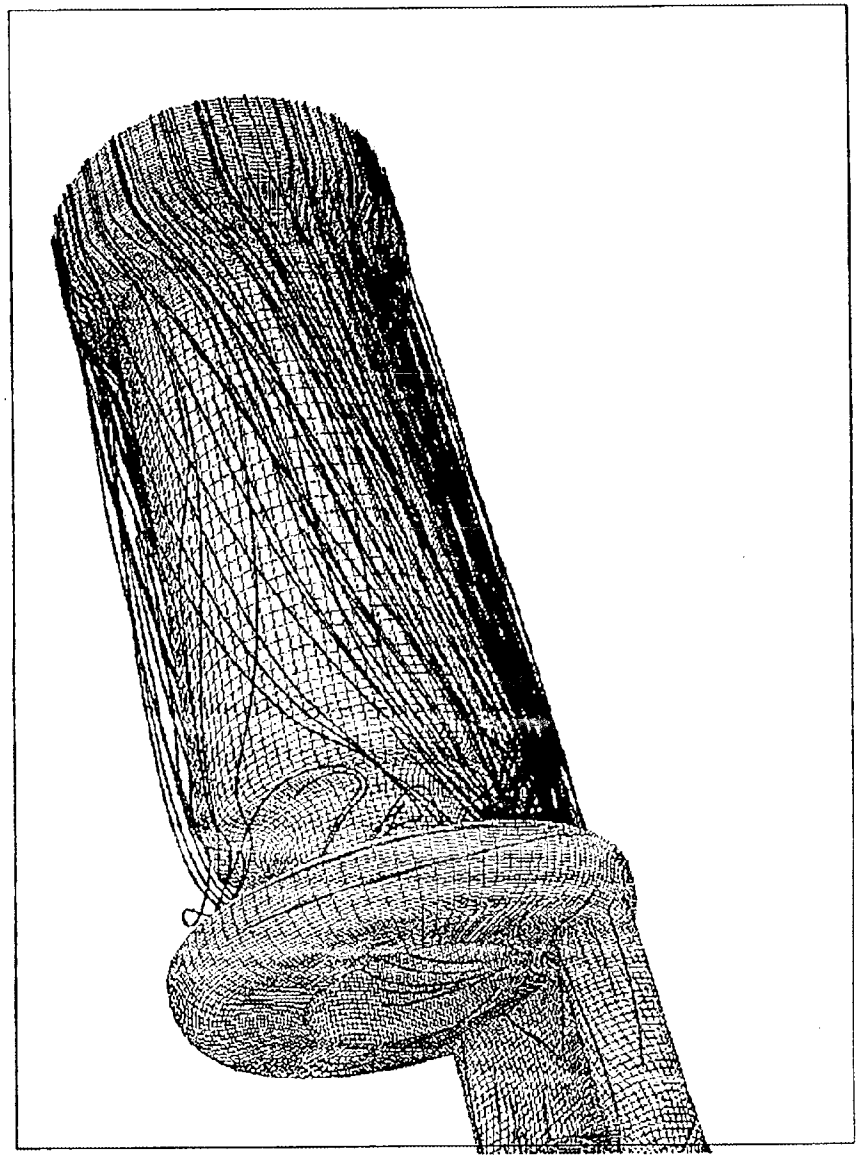
FIG. 7 is an analysis of the mean flow at take-off for the fuel injector of the present invention.
Figure 8:
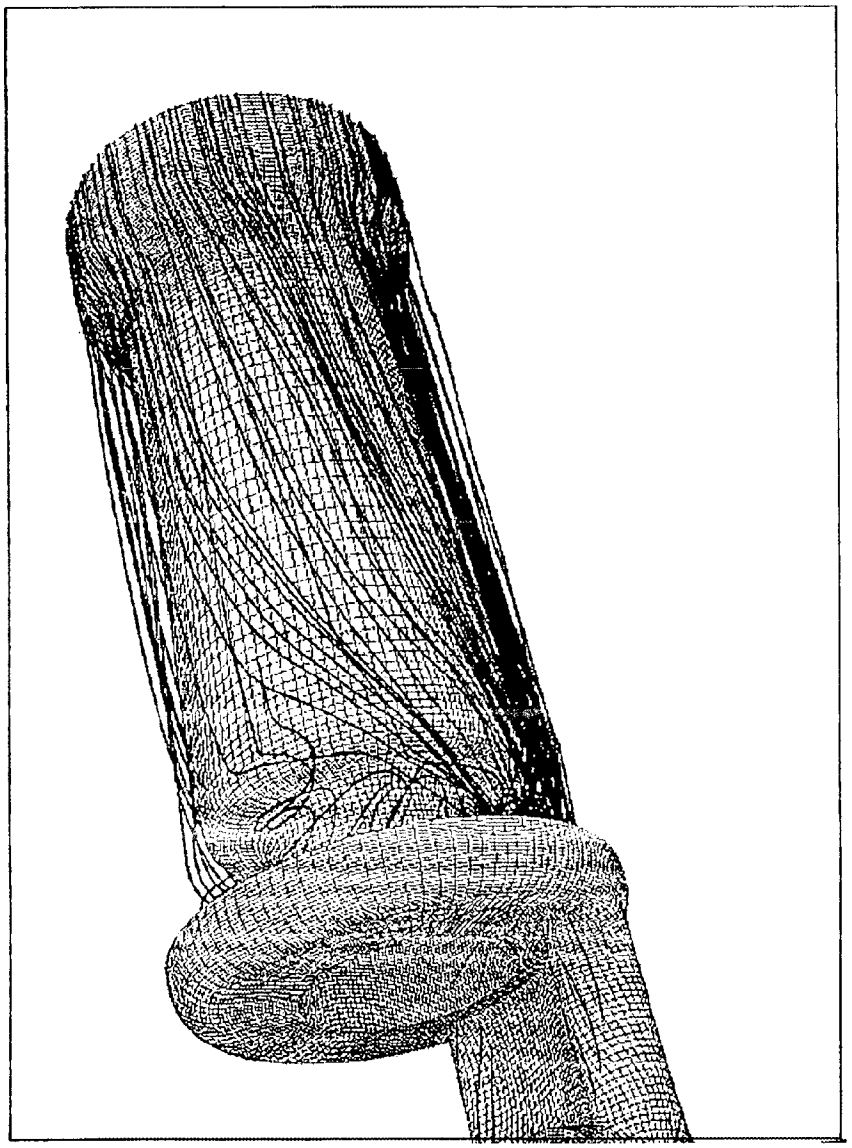
FIG. 8 is an analysis of the mean flow at descent for the fuel injector of the present invention.

As shown in FIGS. 5 and 6, the streamlines of mean flow at take-off (FIG. 5) and descent (FIG. 6) are shown for the conventional prior art nozzle illustrated in FIG. 1. The stream lines for a nozzle constructed according to the present invention under the same analysis parameters, and otherwise having the same structure except for the modified adapter, is shown at take-off (FIG. 7) and descent (FIG. 8). It can be seen that the recirculation zones are reduced, and that their nature has changed (i.e., they have increased flow-through). As such, the residence time of the fuel is reduced, and the heat transfer coefficients are improved. While not shown, it is believed a similar improvement is provided during cruise conditions.

The present invention thereby provides an improved fuel injector for gas turbine engines, and particularly an improved fuel swirler for such an injector, which provides a uniform spray for efficient combustion and stability of the flame and is simple and relatively low-cost to manufacture.

The principles, preferred embodiments and modes of operation of the present invention have been described in the foregoing specification. The invention which is intended to be protected herein should not, however, be construed as limited to the particular form described as it is to be regarded as illustrative rather than restrictive. Variations and changes may be made by those skilled in the art without departing from the scope and spirit of the invention as set forth in the appended claims.

What is claimed is:

1. A fuel injector for a gas turbine engine, the fuel injector comprising:

a housing stem having a fuel conduit for carrying fuel;

a nozzle supported by the housing stem, said nozzle including a fuel passageway directing fuel from the fuel conduit downstream to a discharge orifice at a discharge end of the nozzle, the fuel passageway defined in part by a primary adapter and having an outer surface with a distinct annular, radially-outwardly-projecting shoulder at an upstream end of the primary adapter, the shoulder having a continuously annular, upstream-facing surface, extending radially outward to a rounded peripheral annular edge with a radius, the edge defining a continuously annular passage portion with an internal wall of an outer fuel conduit portion, the adapter inwardly tapering smoothly downstream of the shoulder to a downstream cylindrical portion, to restrict flow through the passageway and provide substantially uniform distribution of flow through the passageway downstream of the shoulder.

2. The fuel injector as in claim 1, wherein a tip adapter is located between the housing stem and nozzle, the tip adapter including a kidney-shaped flow passage fluidly interconnecting the fuel conduit and the fuel passageway.

3. The fuel injector as in claim 1, wherein the upstream-facing surface extends substantially perpendicular to a central axis of the primary adapter, and interconnects a reduced-diameter cylindrical upstream portion of the primary adapter and an increased-diameter cylindrical downstream portion of the primary adapter.

4. The fuel injector as in claim 3, wherein the reduced-diameter cylindrical portion of the primary adapter defines an unobstructed annular flow distribution channel upstream of the shoulder.

5. The fuel injector as in claim 1, further including an annular flow distribution passage upstream of the shoulder, and a flow opening interconnecting the fuel conduit and the fuel passageway, the flow opening directing all the flow from the fuel conduit into only a portion of the annulus of the annular flow distribution passage.

6. The fuel injector as in claim 5, wherein a tip adapter is located between the housing stem and nozzle, the tip adapter including a non-circular flow passage fluidly interconnecting the fuel conduit and the fuel passageway.

7. A fuel injector for a gas turbine engine having a combustor casing with an opening, the fuel injector comprising:

a fitting for receiving fuel, said fitting designed to be located exterior to the combustor casing;

a nozzle for dispensing fuel, said nozzle designed to be located within the combustor casing;

a housing stem extending through the opening between and supporting the fitting and said nozzle, said housing stem having a primary fuel conduit and a secondary fuel conduit fluidly interconnecting the fitting and the nozzle, said nozzle including a primary fuel passageway and a secondary fuel passageway, said primary fuel passageway directing fuel from the primary fuel conduit downstream to a primary discharge orifice at a discharge end of the nozzle and said secondary fuel passageway directing fuel from the secondary fuel conduit to a secondary fuel discharge orifice at the discharge end of the nozzle, the primary fuel passageway defined internally of a primary adapter, and the secondary fuel passageway defined between the primary adapter and an annular outer fuel conduit portion surrounding the primary adapter, the primary adapter having an outer surface with a radially-outwardly-projecting, continuously-annular geometry, the geometry having i) a continuously annular, upstream-facing surface, and ii) a rounded peripheral edge with a radius, the edge defining a continuously annular passage portion with an internal wall of an outer fuel conduit portion, the adapter inwardly tapering smoothly downstream from the geometry to a downstream cylindrical portion, to restrict flow through the secondary fuel passageway and provide substantially uniform distribution of flow through the secondary fuel passageway downstream of the geometry.

8. The fuel injector as in claim 7, wherein the upstream-facing surface extends substantially perpendicular to a central axis of the primary adapter, and interconnects a reduced-diameter cylindrical upstream portion of the primary adapter and an enlarged-diameter cylindrical downstream portion of the primary adapter.

9. The fuel injector as in claim 8, wherein the reduced-diameter cylindrical portion of the primary adapter and the outer fuel conduit portion define an annular unobstructed flow distribution channel upstream of the geometry.

10. The fuel injector as in claim 9, wherein the geometry is at an upstream end of the primary adapter.

11. The fuel injector as in claim 9, wherein a tip adapter is located between the housing stem and nozzle, the tip adapter including a kidney-shaped flow passage fluidly interconnecting the secondary fuel conduit and the secondary fuel passageway.

12. The fuel injector as in claim 7, further including an annular flow distribution passage upstream of the shoulder, and a flow opening interconnecting the fuel conduit and the fuel passageway, the flow opening directing all the flow from the fuel conduit into only a portion of the annulus of the annular flow distribution passage.

13. The fuel injector as in claim 12, wherein a tip adapter is located between the housing stem and nozzle, the tip adapter including a non-circular flow passage fluidly interconnecting the secondary fuel conduit and the secondary fuel passageway.

14. A fuel injection assembly for a gas turbine engine, comprising:

a combustor casing with an opening and a fuel injector, said fuel injector including:

a) a fitting for receiving fuel, said fitting designed to be located exterior to the combustor casing;

b) a nozzle for dispensing fuel, said nozzle designed to be located within the combustor casing; and c) a housing stem extending through the opening between and supporting the fitting and said nozzle, said housing stem having a primary fuel conduit and a secondary fuel conduit fluidly interconnecting the fitting and the nozzle, said nozzle including a primary fuel passageway and a secondary fuel passageway, said primary fuel passageway directing fuel downstream from the primary fuel conduit to a central, primary discharge orifice at a discharge end of the nozzle and said secondary fuel passageway directing fuel from the secondary fuel conduit to an annular, secondary fuel discharge orifice at the discharge end of the nozzle, with the secondary discharge orifice concentrically surrounding the primary discharge orifice, the primary fuel, and the secondary fuel passageway defined between an inner cylindrical surface of an outer fuel conduit portion and an outer cylindrical surface of a primary adapter, the outer cylindrical surface of the adapter having a distinct, radially-outwardly projecting, continuously-annular shoulder at an upstream end of the adapter defining an annular orifice with the outer fuel conduit portion, the shoulder having i) a continuously annular, upstream-facing surface, and ii) a rounded peripheral edge with a radius, the edge defining a continuously annular passage portion with an internal wall of an outer fuel conduit portion, the adapter inwardly tapering smoothly downstream from the shoulder to a downstream cylindrical portion, to restrict flow through the secondary fuel passageway and provide uniform distribution of flow through the secondary passageway downstream of the shoulder.

15. The fuel injection assembly as in claim 14, wherein the annular, upstream-facing surface extends substantially perpendicular to a central axis of the primary adapter, and interconnects a reduced-diameter cylindrical upstream portion of the primary adapter and an increased diameter cylindrical downstream portion of the primary adapter.

16. The fuel injection assembly as in claim 15, wherein the reduced-diameter cylindrical portion of the primary adapter and the outer fuel conduit portion define an annular unobstructed flow distribution channel upstream of the shoulder.

17. The fuel injection assembly as in claim 16, wherein the nozzle has a kidney-shaped flow passage to direct fuel from the secondary fuel conduit into the secondary fuel passageway, the shoulder being located proximate the kidney-shaped flow passage.

18. The fuel injector as in claim 14, further including an annular flow distribution passage upstream of the shoulder, and a flow opening interconnecting the fuel conduit and the fuel passageway, the flow opening directing all the flow from the fuel conduit into only a portion of the annulus of the annular flow distribution passage.

19. The fuel injector as in claim 18, wherein the nozzle has a non-circular flow passage to direct fuel from the secondary fuel conduit into the secondary fuel passageway, the shoulder being located proximate the kidney-shaped flow passage.

* * * * *